US005207268A

United States Patent [19]

Krause et al.

[11] Patent Number: 5,207,268

[45] Date of Patent: May 4, 1993

[54] HIGH-TEMPERATURE HEAT STORAGE SYSTEM

[75] Inventors: Siegfried Krause, Ostelsheim; Friedrich Lindner, Leinfelden-Echterdingen, both of Fed. Rep. of Germany

[73] Assignee: Deutsche Forschungsanstalt fuer Luft- und Raumfahrt e.V., Bonn, Fed. Rep. of Germany

[21] Appl. No.: 902,658

[22] Filed: Jun. 23, 1992

[30] Foreign Application Priority Data

Jun. 28, 1991 [DE] Fed. Rep. of Germany ..... 4121462

[51] Int. Cl.[5] ..... F28D 15/00; F01K 1/04

[52] U.S. Cl. ..... 165/104.11; 165/10; 60/659

[58] Field of Search ..... 165/10 R, 104.11; 60/652, 659

[56] References Cited

U.S. PATENT DOCUMENTS

| | | | |
|---|---|---|---|
| 1,900,766 | 3/1933 | Ruths | 60/659 |
| 1,925,078 | 8/1933 | Ruths | 60/659 |
| 2,167,469 | 7/1939 | Wallin | 60/659 X |

FOREIGN PATENT DOCUMENTS 2458961 6/1976 Fed. Rep. of Germany .

OTHER PUBLICATIONS

Kuhrasch, "Das Verdampfungsvermogen der Hochdruckwarmespeicher," Warme, Luftungs-Und Gesundheitstechnik, pp. 119-122, Dusseldorf, Germany, 1956.

Sauer and Zeise, "Energietransport, -speicherung und -verteilung," Technischer Verlag Resch-Verlag TUV Rheinland, Cologne, Germany, 1983.

*Primary Examiner*—Allen M. Ostrager

*Attorney, Agent, or Firm*—Barry R. Lipsitz

[57] ABSTRACT

To improve a heat storage system comprising a heat source, a heat storage device and a heat sink between which heat is transported by a heat transporting medium such that satisfactory storage and utilization of heat by a heat transporting medium near its critical temperature is possible, it is proposed that the heat storage device be designed as a Ruths storage device, with a bath of liquid required as heat transporting medium for the Ruths storage device being provided in a storage volume, that the storage volume contain in addition to the bath of liquid a latent heat storage material, that the storage temperature be selected so as to lie in the range of the critical temperature of the heat transporting medium and below it, and that the heat storage system be operable in such a way that during the discharging of the heat storage device via the heat sink, the bath of liquid heat transporting medium constantly surrounds the latent heat storage material essentially with thermal contact.

22 Claims, 3 Drawing Sheets

HIGH-TEMPERATURE HEAT STORAGE SYSTEM

Figure 1:
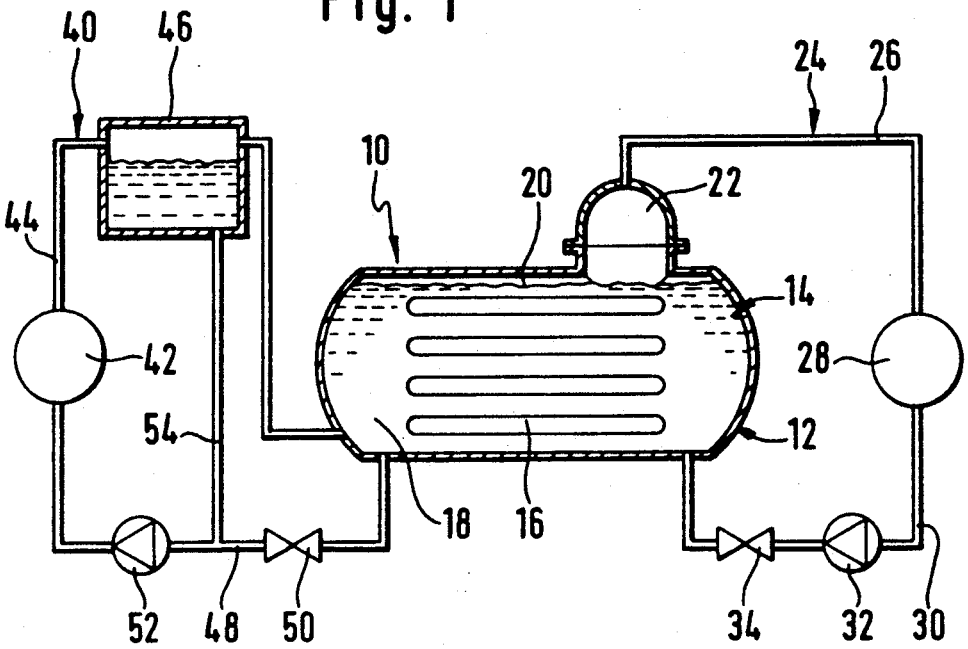

The invention relates to a heat storage system comprising a heat source, a heat storage device and a heat sink or absorber between which heat is transported by a heat transporting medium.

Heat storage systems are known in general. Herein a heat transporting medium is heated by a heat source and the heat transporting medium transports the heat to the heat storage device to charge it and store the heat. Discharging is carried out subsequently by the heat being transported by the heat transporting medium to the heat sink.

It is, furthermore, known to provide devices for storing sensitive heat with encapsulated latent heat storage material to obtain higher volumetric capacities or improved temperature behavior.

It is also known to provide a Ruths storage device with an encapsulated latent heat storage material to achieve constant pressure and temperature behavior at the low level of the consumers but nevertheless a high charging and discharging capacity.

The problem with the heat storage systems and heat storage devices known from the prior art is that satisfactory storage and utilization of heat even with the help of the phase change of a heat transporting medium, in particular water, near its critical temperature, are not possible in a purposeful way with the storage devices known so far as the enthalpy change $\Delta H$ and the associated alteration of density $\Delta Q$ are too small and so purposeful discharging and charging of such a heat storage device in a heat storage system would not seem possible.

The object underlying the invention is, therefore, to so improve a heat storage system of the generic kind that satisfactory storage and utilization of heat by a heat transporting medium near its critical temperature are possible.

This object is accomplished in accordance with the invention in a heat storage system of the kind described at the beginning by the heat storage device being designed as a Ruths storage device, a bath of liquid required as heat transporting medium for the Ruths storage device being provided in a storage volume, by the storage volume containing in addition to the bath of liquid a latent heat storage material, by the storage temperature being selected so as to lie in the range of the critical temperature of the heat transporting medium and below it, and by the heat storage system being operable in such a way that during the discharging of the heat storage system via the heat sink, the bath of liquid heat transporting medium constantly surrounds the latent heat storage material essentially with thermal contact.

The design of the heat storage device according to the invention as a Ruths storage device includes the fact that for the transferring of the heat, the heat transporting medium is evaporated in the heat source and preferably fed as supercritical steam to the heat storage device containing the bath of liquid heat transporting medium so that upon contact with the bath of liquid, the steam releases its heat to the bath of liquid which, in turn, heats the latent heat storage material. The steam preferably condenses likewise to liquid upon contact with the bath of liquid.

Operation of the heat storage system according to the invention with heat transporting medium near its critical temperature and provision of latent heat storage material in the heat storage device to increase its capacity make it necessary for a large amount of steam to be introduced into the heat storage device in order to fully charge it and the latent heat storage material. On the other hand, during the discharging of such a heat storage device, it is necessary to remove a large amount of steam from the heat storage device in order to completely discharge it and, in particular, the latent heat storage material.

Such complete discharging of the latent heat storage material is carried out in accordance with the invention by the bath of liquid always being of such size that the latent heat storage material is surrounded by the bath of liquid essentially with thermal contact so the latent heat storage material can release its heat completely to the bath of liquid and the heat transporting medium then evaporates from this bath of liquid heat transporting medium owing to the constant supply of heat via the latent heat storage material.

One possibility of maintaining the aforementioned condition that the bath of liquid must always surround the latent heat storage material essentially with thermal contact is for the heat storage system to comprise a discharging circuit containing the heat storage device and the heat sink for conducting vaporous heat transporting medium from the heat storage device to the heat sink and returning heat transporting medium which has condensed in the heat sink in liquid form to the heat storage device and feeding it into the bath of liquid contained therein. It is thereby made possible for a substantially larger amount of steam to flow through the discharging circuit than would be possible with simple evaporation of the bath of liquid and, therefore, on the one hand, the bath of liquid can be kept as small as possible and, on the other hand, there is no limitation as to how much steam has to flow through the discharging circuit in order to completely discharge the heat storage device for with the returning of the condensed heat transporting medium to the heat storage device, the heat transporting medium is heated again by the latent heat storage material and can thus evaporate again.

Herein it is particularly advantageous for the discharging circuit to contain a circulating pump for ensuring that, in particular, the condensed heat transporting medium is returned from the heat sink to the heat storage device.

One advantageous possibility of charging the heat storage system according to the invention consists in the heat storage system comprising a charging circuit containing the heat source and the heat storage device. Herein the charging circuit feeds liquid heat transporting medium from the bath of liquid of the heat storage device to the heat source and returns heat transporting medium evaporated by the heat source to the heat storage device and makes it condense in the bath of liquid. Owing to the constant circulation of the heat transporting medium between the heat storage device and the heat source, a large amount of steam is thus made available to completely charge the heat storage device as the condensed heat transporting medium is, in turn, constantly removed from the heat storage device and fed to the heat source until the heat storage device and, in particular, its latent heat storage material are completely charged.

It is, furthermore, advantageous for the charging circuit to comprise a charge pump.

A further possibility of designing a heat storage system according to the invention, as explained at the beginning in connection with the invention, consists in a supplementary tank for liquid heat transporting medium kept at the storage temperature being associated with the heat storage device and in liquid heat transporting medium being fed from the supplementary tank to the bath of liquid during the discharging of the heat storage device so that during the discharging the bath of liquid constantly surrounds the latent heat storage material essentially with thermal contact.

Herein it is particularly advantageous for a supplementary pump to be provided between the supplementary tank and the heat storage device to feed the bath of liquid with liquid heat transporting medium from the supplementary tank. This supplementary pump is advantageously controlled by a control means which monitors the bath of liquid in the heat storage device.

To enable a heat storage system of such design to be charged, provision is made for the supplementary tank to be fillable with liquid heat transporting medium at the storage temperature $T_s$ during the charging of the heat storage device.

It is, in principle, conceivable for the supplementary tank to be filled directly and for heat to then be transferred to the latent heat storage material by circulation between the supplementary tank and the bath of liquid.

However, it is particularly advantageous for the liquid, condensed heat transporting medium to be fed from the heat storage device to the supplementary tank, i.e., in this case, for the vaporous heat transporting medium coming from the heat source to first be fed to the heat storage device where it releases its heat to the bath of liquid and to the latent heat storage material, and for the condensed heat transporting medium, insofar as it can no longer be accommodated by the heat storage device, to then be fed to the supplementary tank.

In a heat storage system designed in accordance with the aforementioned features there is no circulation of the heat transporting medium through the heat storage device during the charging or discharging, and, therefore, provision is preferably made for condensed heat transporting medium to be feedable to the heat source from a buffer tank during the charging and for heat transporting medium evaporated by the heat source to be feedable via a charge line to the heat storage device for condensation therein.

For the discharging of such a heat storage system a discharge line leading from the heat storage device to the heat sink is provided. During the discharging, heat transporting medium which has evaporated in the heat storage device is transported in the discharge line to the heat sink and releases heat by means of condensation in the heat sink.

The condensed heat transporting medium is removed by providing between the heat sink and the heat source a condensate line in which condensed heat transporting medium can be transported from the heat sink to the heat source.

Since this embodiment of the heat storage system should preferably be designed as a closed system and heat should be temporarily stored in the heat storage device and discharging should also be possible whenever there is no supply of heat from the heat source at the same time, it is advantageous for the condensate line to contain the buffer tank for condensed heat transporting medium so that the condensed heat transporting medium is temporarily stored in the buffer tank until the heat transporting medium is removed from the buffer tank again for evaporation in the heat source.

The condensate line advantageously contains a pump for ensuring flow of the condensed heat transporting medium in the condensate line.

In a further advantageous, alternative implementation of the inventive preconditions mentioned at the beginning for a heat storage system according to the invention, the heat storage device comprises an additional storage volume for liquid heat transporting medium which the liquid heat transporting medium enters during the charging when the latent heat storage material is surrounded by the bath of liquid essentially with thermal contact, and, during the discharging, at most such an amount of liquid heat transporting medium is evaporatable in the heat storage device that the additional storage volume is emptied but the bath of liquid still constantly surrounds the latent heat storage material essentially with thermal contact.

Such an arrangement preferably comprises a base volume in which the latent heat storage material is surrounded by the bath of liquid with thermal contact and above this base volume the additional storage volume which is used to a greater or lesser extent by the bath of liquid depending upon the state of the heat storage device.

In particular, in such a conception of a heat storage system according to the invention, provision is made for condensed heat transporting medium to be feedable to the heat source from the buffer tank and for heat transporting medium evaporated by the heat source to be introducible into the bath of liquid of the heat storage device via a charge line.

It is also advantageous to provide a discharge line for feeding vaporous heat transporting medium from the storage volume to the heat sink.

To ensure a return flow of the heat transporting medium which has condensed in the heat sink, a condensate line is advantageously provided between the heat sink and the heat source to feed the heat transporting medium which has condensed in the heat sink to the heat source.

Since heating of the heat transporting medium in the heat source usually takes place at a different point in time than condensation of the heat transporting medium in the heat sink, a buffer tank is advantageously provided in the condensate line for temporarily storing the heat transporting medium which has condensed in the heat sink so that it can be fed to the heat source later via a condensate intake line.

A pump is advantageously provided in the condensate line for ensuring flow of the condensed heat transporting medium in the condensate line.

In all of the heat storage systems according to the invention, it is, furthermore, advantageous for a connection line to be provided between the charge line and the discharge line so that it is possible to conduct evaporated heat transporting medium directly from the heat source to the heat sink, thereby bypassing the heat storage device, if there is to be direct coupling between the heat source and the heat sink, and to store the heat transporting medium in the heat storage device only when temporary storage is necessary.

In the heat storage system according to the invention, it is particularly advantageous for the heat transporting medium to be water which is stored in the heat storage device at a temperature near its critical temperature.

Solar systems in which the heat transporting medium, in particular the water, is heated by direct solar radiation preferably serve as heat source. Use of a heat exchanger, a steam turbine or any other thermal power machine is, for example, conceivable as heat sink. It is, however, also conceivable to use heating devices for buildings directly as heat sink.

Figure 2:
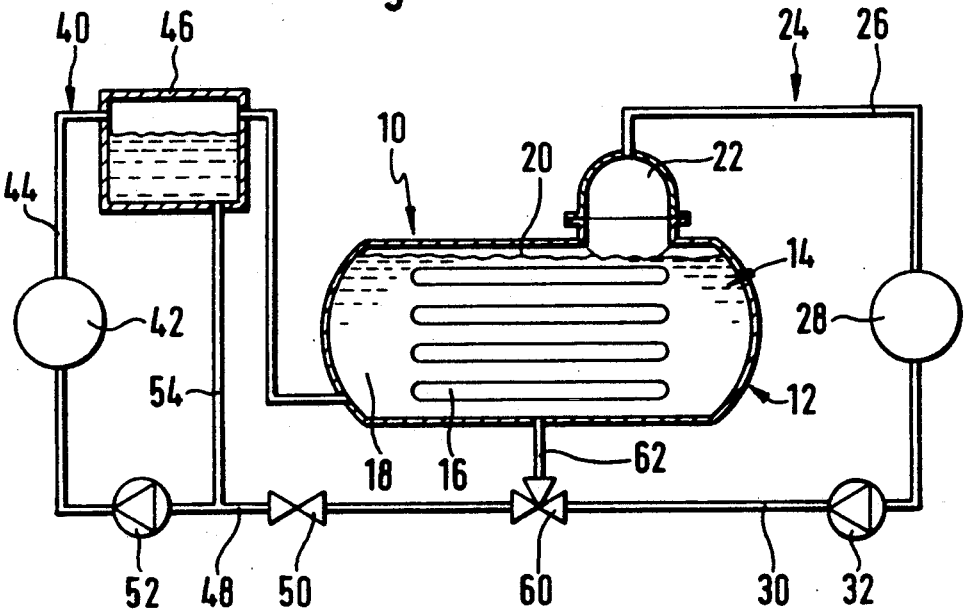
Figure 3:
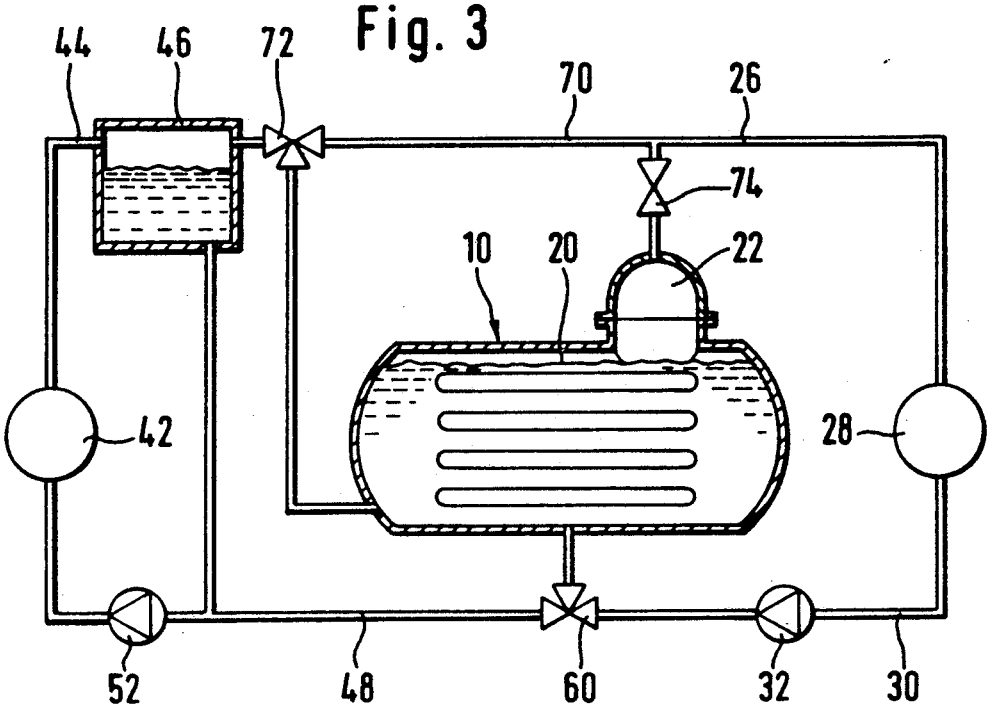
Figure 4:
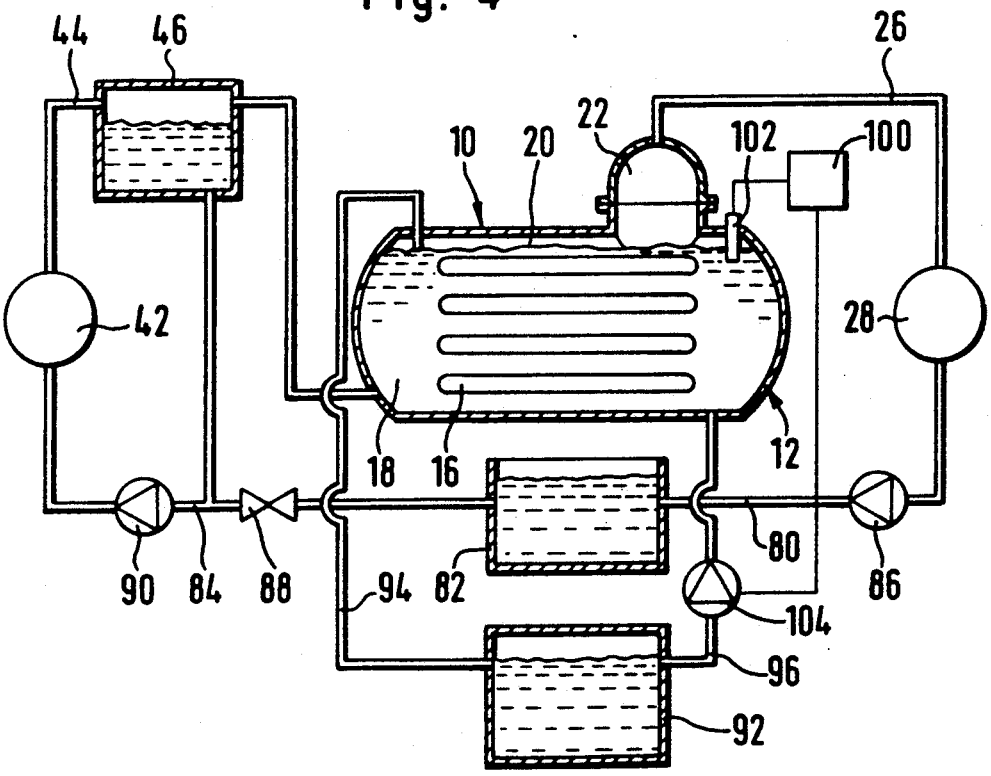
Figure 5:
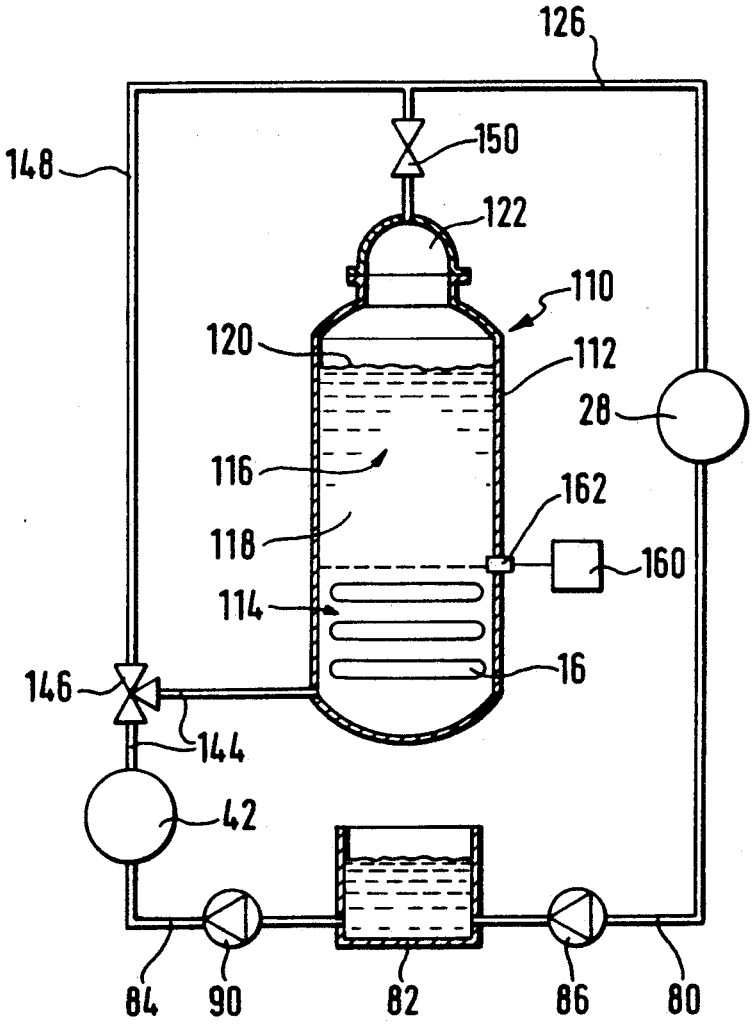

Further features and advantages of the invention are set forth in the following description and the appended drawings of several embodiments. The drawings show:

FIG. 1 a schematic representation of a first embodiment of a heat storage system according to the invention;

FIG. 2 a schematic representation of a second embodiment of a heat storage system according to the invention;

FIG. 3 a schematic representation of a third embodiment of a heat storage system according to the invention;

FIG. 4 a schematic representation of a fourth embodiment of a heat storage system according to the invention; and FIG. 5 a schematic representation of a fifth embodiment of a heat storage system according to the invention.

A first embodiment of a heat storage system according to the invention, illustrated in FIG. 1, comprises a heat storage device designated 10 and designed as a hybrid steam storage device.

This heat storage device 10 comprises a storage container 12 which delimits a storage volume 14. Encapsulated latent heat storage material 16 is arranged in this storage volume 14 with a heat transporting medium flowing around it. The latent heat storage material :s preferably present in the form of pellets, and a chemical substance suitable for the respective use is chosen for the latent heat storage material.

Suitable substances for latent heat storage materials for such a heat storage device 10 are indicated with their chemical formulas in the following table:

| Latent heat storage material | Heat storage capacity kJ/l | Melting temperature °C. | Associated steam saturation pressure in Ruths storage device bar |
|---|---|---|---|
| $NaNo_3$ | 421 | 306 | 95 |
| $Na_2N_2O_2$ | 422 | 315 | 108 |
| NaOH | 446 | 318 | 112 |
| $ZnCl_2$ | 493 | 283 | 68 |
| $AlCl_3$ | 650 | 192 | 13.4 |
| $FeCl_3$ | 766 | 304 | 93 |
| $LiNO_3$ | 875 | 264 | 51 |
| Bi | 492 | 271 | 57 |
| Cd | 467 | 321 | 112 |

As the heat storage device 10 according to the invention is designed as a Ruths storage device, a heat transporting medium is selected which will condense in the heat storage device 10 in the form of a bath of liquid 18. A liquid level 20 of the bath of liquid 18 in the storage container 12 may vary.

Examples of a Ruths storage device, combined with a latent heat storage material, are given in the magazine BWK, Volume 39 (1987) No. 12 - December. Herein reference is expressly made to the cited disclosure.

Seated on the storage container 12 is a steam dome 22 into which the liquid heat transporting medium evaporates from the bath of liquid 18 during the discharging.

A discharging circuit designated in its entirety 24 is provided for discharging the charged heat storage device 10. The discharging circuit 24 comprises a discharge line 26 leading away from the steam dome 22, in particular from its highest point, a heat sink 28 connected to the discharge line 26 and a condensate return line 30 leading from the heat sink 28 to the heat storage device 10. A discharge pump 32 and a discharge valve 34 are arranged in succession in the condensate return line 30.

The condensate return line 30 leads back into the storage container 12 and preferably discharges into a bottom area thereof.

During the discharging of the heat storage device 10 according to the invention, the pressure in the discharge line 26 is reduced by the discharge valve 34 being opened and the discharge pump 32 operating in the condensate return line 30 so that heat transporting medium evaporates from the bath of liquid 18 and flows in vaporous form into the steam dome 22 from which it then enters the discharge line 26 which conducts the vaporous heat transporting medium to the heat sink 28 in which the heat transporting medium condenses. This condensed heat transporting medium is then conveyed via the condensate return line 30 by the discharge pump 32 into the heat storage device 10 and fed to the bath of liquid 18 in which it can again absorb heat from the bath of liquid 18 and also from the latent heat storage material 16.

During the discharging of the heat storage device 10, the condensate return line 30 thus ensures that the liquid level 20 is always kept at such a level that the latent heat storage material 16 is constantly surrounded by the bath of liquid 18 essentially with thermal contact and so during the entire discharging the latent heat storage material 16 can release the stored heat to the bath of liquid 18 from which the heat transporting medium then evaporates.

The first embodiment of the inventive heat storage system according to FIG. 1 also comprises a charging circuit designated in its entirety 40. The charging circuit 40 comprises a charge line 44 which leads from a heat source 42 to the storage container 12 and contains a condensate separator 46.

The charging circuit 40 further comprises a liquid intake line 48 leading away from a bottom area of the storage container 12 and discharging into the heat source 42.

A charge valve 50 and a charge pump 52 are also arranged in this liquid intake line 48.

To return condensed heat transporting medium which has collected in the condensate separator 46 to the charging circuit 40, a compensation line 54 leads from the condensate separator 46 to the liquid intake line 48 and discharges into it preferably between the charge valve 50 and the charge pump 52.

To charge the heat storage device 10 according to the invention, condensed heat transporting medium is fed to the heat source 42 from the bath of liquid 18 via the liquid intake line 48. During this the charge valve 50 is open and the charge pump 52 is operating.

The heat transporting medium evaporates in the heat source 42 and enters the charge line 44 in vaporous form.

The condensate separator 46 is merely provided for separating condensate still present in the vapor of the charge line 44 and not introducing it into the heat storage device 10. It is, in principle, not required for the inventive functioning of the system. In the same way, the discharge line 26, 126 may contain a condensate separator before the heat sink 28. Such a condensate separator is likewise not absolutely necessary but is, for example, recommendable when a turbine is used as heat sink. After flowing through the condensate separator 46, the vaporous heat transporting medium is introduced by the charge line 44 into the heat storage device 10 according to the invention, preferably into a bottom area of the storage container 12 thereof.

The vaporous heat transporting medium flows through the bath of liquid 18 and condenses upon contact with the bath of liquid 18, thereby releasing its heat to the bath of liquid 18 and also to the latent heat storage material 16.

The inventive heat storage device 10 is operated in the heat storage system according to the invention in such a way that the storage temperature $T_s$ lies in the range of the critical temperature $T_k$ of the heat transporting medium but below it so that condensation of the vaporous heat transporting medium will always take place.

Owing to the heat of condensation of the heat transporting medium being very small compared with the heat of fusion of the latent heat storage material, a multiple of the amount of vapor present in condensed form in the bath of liquid 18 in the storage container 12 is required for charging the heat storage device 10 according to the invention. However, the charging circuit 40 according to the invention allows the same amount of condensed heat transporting medium to run through the charging circuit a number of times so that the heat storage capacity of the inventive heat storage device 10 with the latent heat storage material 16 is thereby fully exhaustable.

In a second embodiment of the heat storage system according to the invention, illustrated in FIG. 2, those parts identical with those of the first embodiment according to FIG. 1 have the same reference numerals. Therefore, for a description of these, reference is to be had to the statements on the first embodiment.

In contrast with the first embodiment, the condensate return line 30 does not lead directly to the storage container 12 and the liquid intake line 48 does not lead directly away from the storage container 12 but instead both lead to a three-way valve 60 from which a branch line 62 additionally leads to the storage container 12 and discharges into a bottom area thereof. Therefore, depending on the position of the three-way valve 60 either discharging or charging of the heat storage device 10 via the discharging circuit 24 or the charging circuit 40 is possible or both discharging and charging at the same time are also possible, in which case the three-way valve 60 has to be adjusted accordingly.

Furthermore, owing to provision of the three-way valve 60, the discharge valve 34 in the condensate return line 30 can be dispensed with.

A third embodiment of a heat storage system according to the invention, illustrated in FIG. 3, has, insofar as its parts are identical with those of the first and second embodiments, the same reference numerals. Therefore, reference is to be had to the statements on the first and second embodiments for a description of these parts.

In contrast with the first and second embodiments, the discharge line 26 and the charge line 44 are connectable with one another via a connection line 70. The charge line 44 contains a three-way valve 72 from which the connection line 70 leads away and then opens into the discharge line 26 after a discharge valve 74 following the steam dome 22 in the discharge line 26.

In the third embodiment of the heat storage system according to the invention, corresponding actuation of the three-way valve 72 thus makes it possible for heat transporting medium evaporated in the heat source 42 to be directly introduced into the discharge line 26, thereby bypassing the heat storage device 10. In this case, the discharge valve 74 is closed so that the heat transporting medium will be fed directly by the discharge line 26 to the heat sink 28 and condense there, the condensed heat transporting medium then being returned by the discharge pump 32 via the condensate return line 30 and through the three-way valve 60 to the liquid intake line 48 :n which the charge pump 52 ensures that the condensed heat transporting medium is fed to the heat source 42 in which the liquid heat transporting medium, in turn, evaporates.

Only when the heat energy is to be stored, is the threeway valve 72 switched over so that the charge line 44, as in the first and second embodiments, will introduce the vaporous heat transporting medium into the heat storage device 10 from which the heat is removed at a later point in time. The discharge valve 74 is then opened. Charging and discharging of the heat storage device 10 are carried out in the same way as described in conjunction with the first embodiment.

A fourth embodiment of a heat storage system according to the invention, illustrated in FIG. 4, comprises a heat storage device 10 which is designed in the same way as the heat storage device 10 of the three embodiments described hereinabove.

Furthermore, those parts identical with those of the first embodiment have the same reference numerals. Therefore, for a description of these, reference is to be had to the statements hereinabove on the previous embodiments.

In contrast with the first three embodiments, however, there is neither a discharging circuit 24 nor a charging circuit 40.

Instead, the discharge line 26 leads to the heat sink 28 and from this a condensate line 80 leads to a buffer tank 82 and from the buffer tank 82 a condensate intake line 84 leads to the heat source 42, a first condensate pump 86 being provided in the condensate line 80 for pumping the condensate occurring in the heat sink 28 into the buffer tank 82. Furthermore, the condensate line 84 contains after the buffer tank 82 an intake valve 88 followed by a second condensate pump 90 for pumping condensate from the buffer tank 82 to the heat source 42, for which purpose the intake valve 88 is opened.

The charge line 44 containing, as in the embodiments described hereinabove, a condensate separator 46 leads from the heat source 42 to the storage container 12 of the heat storage device 10, and the discharge line 26 described hereinabove leads away from the steam dome 22 thereof in the same way as in the previous embodiments.

In the fourth embodiment, in contrast with the three embodiments described hereinabove, there is no circulation of the heat transporting medium during the charging and discharging, and, therefore, the entire heat transporting medium flowing through the charge line 44 has to be stored as condensed heat transporting medium. A supplementary tank 92 associated with the heat storage device 10 for this purpose is connected via a filler line 94 and a return line 96 to the storage container 12.

The filler line 94 opens into a top region of the storage container 12 so that when the liquid level 20 of the bath of liquid 18 exceeds the highest permissible level in the storage container 12, the condensed heat transporting medium flows into the supplementary tank 92 via the filler line 94 until the supplementary tank 92 is full.

During the charging of the heat storage device 10, after the intake valve 88 has been opened and the second condensate pump 90 switched on, condensed heat transporting medium is pumped out of the buffer tank 82 :into the heat source 42, evaporates there and flows as vaporous heat transporting medium through the charge line 44, enters the storage container 12 and upon contact with the bath of liquid 18 releases :its heat to the bath of liquid 18 and via it to the latent heat storage material 16. The vaporous heat transporting medium thereby condenses, in turn, to liquid heat transporting medium and so the liquid level 20 in the storage container 12 rises.

For collecting the condensed heat transporting medium which is no longer storable in the storage container 12, the filler line 94 is provided with the supplementary tank 92 which is of such dimensions that it is full when an amount of heat transporting medium sufficient to completely charge the latent heat storage material 16 has flowed through the storage container 12.

The heat storage device 10 is discharged in exactly the same way as in the first embodiment by a reduction in the pressure being brought about and heat transporting medium evaporating from the bath of liquid 18 and entering the discharge line 26 via the steam dome 22. The liquid level 20 in the storage container 12 then drops.

In order to prevent the bath of liquid 18 from no longer surrounding the latent heat storage material essentially with thermal contact and hence a situation in which the latent heat storage material can no longer release the storage heat to a sufficient extent, a control means 100 is provided for detecting by means of a sensor 102 the dropping of the liquid level 20 and activating a supplementary pump 104 arranged in the return line 96 to pump sufficient condensed heat transporting medium from the supplementary tank 92 into the storage container 12 to keep the liquid level 20 at such a level that the latent heat storage material is constantly surrounded by the bath of liquid essentially with thermal contact. The heat transporting medium condensed in the heat sink 28 is then pumped by the condensate pump 86 via the condensate line 80 into the buffer tank 82 which is thereby filled up again.

Emptying of the heat storage device 10 is possible until the supplementary tank 92 is pumped empty and the bath of liquid 18 continues to completely surround the latent heat storage material essentially with thermal contact.

The embodiment according to FIG. 4 may also be modified such that the buffer tank 82 and the supplementary tank 92 are identical and the four lines leading to the buffer tank 82 and the supplementary tank 92 open into this one tank.

In a fifth embodiment, illustrated in FIG. 5, the heat storage device 110 is not identical with the heat storage device 10 of the first four embodiments.

This heat storage device 110 comprises a storage container 112 in which the latent heat storage material 16 is arranged. In particular, the latent heat storage material 16 and a bath of liquid heat transporting medium surrounding it are located in a base volume 114 of the storage container 112.

The storage container 112 comprises in addition to the base volume 114 a storage volume 116 which preferably lies above the base volume 114.

Therefore, the liquid level 120 of a bath of liquid 118 forming from condensed heat transporting medium in the storage container 112 lies at least above the base volume 114 and preferably in the additional storage volume 116, and, at the most, the liquid level 120 will lie at the highest filling level of the additional storage volume 116.

Extending upwards from the storage container 112 is a steam dome 122 from which a discharge line 126 leads away and opens into the heat sink 28 from which the condensate line 80 with the first condensate pump 86 then leads into the buffer tank 82. The condensate line 84 with the second condensate pump 90, in turn, leads from the buffer tank 82 to the heat source 42.

The condensate line 80, the condensate intake line 84 and the first and second condensate pumps 86 and 90 are arranged as in the fourth embodiment and cooperate in the way described in connection with this embodiment with the buffer tank 82 to temporarily store in the buffer tank 82 heat transporting medium which has condensed in the heat sink 28 and, in turn, feed it from the buffer tank 82 to the heat source 42.

A charge line 144 containing a three-way valve 146 leads from the heat source 42 to the storage container 112 and preferably opens in a lower region of the storage container 12 into the base volume 114.

Furthermore, a connection line 148 leads from the threeway valve 146 to the discharge line 126 and opens into it after a discharge valve 150 which is arranged between the point at which the connection line 148 opens into the discharge line 126 and the steam dome 122.

This fifth embodiment operates by the second condensate pump 90 pumping from the buffer tank 82 to the heat source 42 condensed heat transporting medium which then evaporates in the heat source 42 and flows as vapor through the charge line 144 into the storage container 112 where upon contact with the condensed heat transporting medium present in the base volume 114 it releases its heat to this heat transporting medium and to the latent heat storage material 16 surrounded by it.

The vaporous heat transporting medium condenses in the bath of liquid 118 so that the liquid level 120 rises constantly and travels to an increasing extent during the charging of the heat storage device 110 into the additional storage volume 116 until it is likewise completely filled up by the bath of liquid 118.

The additional storage volume 116 is of such dimensions that the condensed heat transporting medium storable in it corresponds approximately to the amount of heat transporting medium required to completely charge the latent heat storage material 16.

The heat storage device 110 is discharged by opening the discharge valve 150 to reduce the pressure so that heat transporting medium evaporates from the bath of liquid 118 and the vapor flows through the discharge line 126 to the heat sink 128 where it condenses and is conveyed as condensate by the first condensate pump via the condensate line to the buffer tank 82.

The discharging of the heat storage device 110 according to the invention is carried out until the additional storage volume 116 is emptied and the bath of liquid 118 only lies in the base volume 114 in which it completely surrounds the latent heat storage material essentially with thermal contact. In this case, the liquid level 120 lies approximately at the boundary line between the base volume 114 and the additional storage volume 116.

When this storage device is charged again, the bath of liquid 118 then rises again—as described hereinabove—and fills up the additional storage volume 116 to an increasing extent.

To prevent the bath of liquid 118 from no longer filling up the base volume 114, a control means 160 is provided for detecting via a sensor 162 the liquid level 120 and closing the discharge valve 150 when the liquid level 120 stands between the base volume 114 and the additional storage volume 116.

Furthermore, to supply the heat sink 28 directly with heat, the discharge valve 150 is closed and the threeway valve 146 is switched over so that the heat transporting medium evaporated in the heat source 42 can flow directly from the charge line 144 via the connection line 148 to the discharge line 126, thereby bypassing the heat storage device 110. The condensate :s then pumped off from the heat sink 28 in the same way as in the discharging of the heat storage device 110 by the first condensate pump 86.

In principle, the embodiment according to FIG. 5 can also be designed so as to eliminate the tank 82 which is then identical with the volume 116. The line 80 after the pump 86 will then lead into the bottom area of the partial volume 114 and the line 84 with its pump 90 will leave this partial volume 114 at approximately the same level.

The present disclosure relates to the subject matter disclosed in German application No. P 41 21 462.5 of Jun. 28, 1991, the entire specification of which is incorporated herein by reference.

What is claimed is:

1. Heat storage system comprising a heat source, a heat storage device and a heat sink between which heat is transported by a heat transporting medium, said heat storage device being designed as a Ruths storage device, a bath of liquid required as heat transporting medium for said Ruths storage device being provided in a storage volume, said storage volume containing in addition to said bath of liquid a latent heat storage material, the storage temperature being selected so as to lie in the range of the critical temperature of said heat transporting medium and below it, and said heat storage system being operable in such a way that during the discharging of said heat storage device via said heat sink, said bath of liquid heat transporting medium constantly surrounds said latent heat storage material essentially with thermal contact.

2. Heat storage system as defined in claim 1, characterized in that said heat storage system comprises a discharging circuit containing said heat storage device and said heat sink for conducting vaporous heat transporting medium from said heat storage device to said heat sink and for returning heat transporting medium which has condensed in said heat sink in liquid form to said heat storage device and feeding it to said bath of liquid contained therein.

3. Heat storage system as defined in claim 2, characterized in that said discharging circuit contains a discharge pump.

4. Heat storage system as defined in claim 1, characterized in that said heat storage system comprises a charging circuit containing said heat source and said heat storage device for conducting liquid heat transporting medium from said bath of liquid of said heat storage device to said heat source and returning heat transporting medium evaporated by said heat source to said heat storage device and making it condense in said bath of liquid.

5. Heat storage system as defined in claim 4, characterized in that said charging circuit contains a charge pump.

6. Heat storage system as defined in claim 1, characterized in that a supplementary tank for liquid heat transporting medium kept at said storage temperature is associated with said heat storage device, and in that during the discharging of said heat storage device liquid heat transporting medium is fed from said supplementary tank to said bath of liquid so that during the discharging said bath of liquid constantly surrounds said latent heat storage material essentially with thermal contact.

7. Heat storage system as defined in claim 6, characterized in that a supplementary pump is provided between said supplementary tank and said heat storage device to feed liquid heat transporting medium from said supplementary tank to said bath of liquid.

8. Heat storage system as defined in claim 6, characterized in that during the charging of said heat storage device, said supplementary tank is fillable with liquid heat transporting medium at said storage temperature.

9. Heat storage system as defined in claim 8, characterized in that liquid, condensed heat transporting medium is feedable from said heat storage device into said supplementary tank.

10. Heat storage system as defined in claim 6, characterized in that during the charging, condensed heat transporting medium is feedable to said heat source from a buffer tank, and in that heat transporting medium evaporated by said heat source is feedable via a charge line into said heat storage device for condensation.

11. Heat storage system as defined in claim 6, characterized in that a discharge line leading from said heat storage device to said heat sink is provided, and in that during the discharging, heat transporting medium which has evaporated in said heat storage device is transportable in said discharge line to said heat sink and releases heat in it by condensation.

12. Heat storage system as defined in claim 6, characterized in that a condensate line is provided between said heat sink and said heat source for transporting condensed heat transporting medium from said heat sink to said heat source.

13. Heat storage system as defined in claim 12, characterized in that said buffer tank for condensed heat transporting medium is provided in said condensate line.

14. Heat storage system as defined in claim 6, characterized in that said buffer tank and said supplementary tank are replaced by a common tank.

15. Heat storage system as defined in claim 1, characterized in that said heat storage device comprises an additional storage volume for liquid heat transporting medium which said liquid heat transporting medium enters during the charging when said latent heat storage material is surrounded by said bath of liquid essentially with thermal contact, and in that during the discharging, at most such an amount of said liquid heat transporting medium is evaporatable in said heat storage device that said additional storage volume is emptied but said bath of liquid still constantly surrounds said latent heat storage material essentially with thermal contact.

16. Heat storage system as defined in claim 15, characterized in that condensed heat transporting medium is feedable to said heat source from a buffer tank, and in that heat transporting medium evaporated by said heat source is feedable via a charge line into said bath of liquid of said heat storage device.

17. Heat storage system as defined in claim 15, characterized in that a discharge line is provided for feeding vaporous heat transporting medium from said storage volume to said heat sink.

18. Heat storage system as defined in claim 15, characterized in that a condensate line is provided between said heat sink and said heat source for feeding heat transporting medium which has condensed in said heat sink to said heat source.

19. Heat storage system as defined in claim 18, characterized in that a buffer tank is provided in said condensate line.

20. Heat storage system as defined in claim 18, characterized in that a pump is provided in said condensate line.

21. Heat storage system as defined in claim 1, characterized in that a connection line is provided for directly feeding vaporous heat transporting medium from said heat source to said heat sink thereby bypassing said heat storage device.

22. Heat storage system as defined in claim 16, characterized in that said buffer tank is identical with said additional storage volume.

* * * * *